US011081308B2

(12) United States Patent
Urrea et al.

(10) Patent No.: US 11,081,308 B2
(45) Date of Patent: Aug. 3, 2021

(54) VERTICAL SURFACE MOUNT DEVICE PASS-THROUGH FUSE

(71) Applicant: Littelfuse, Inc., Chicago, IL (US)

(72) Inventors: Julio C. Urrea, Chicago, IL (US); Gary M. Bold, Palatine, IL (US); Matthew David Yurkanin, Mount Prospect, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 16/942,169

(22) Filed: Jul. 29, 2020

(65) Prior Publication Data

US 2021/0043408 A1 Feb. 11, 2021

Related U.S. Application Data

(60) Provisional application No. 62/883,229, filed on Aug. 6, 2019.

(51) Int. Cl.
*H01H 85/041* (2006.01)
*H01H 85/20* (2006.01)
(Continued)

(52) U.S. Cl.
CPC ..... *H01H 85/20* (2013.01); *H01H 85/055* (2013.01); *H01H 85/143* (2013.01);
(Continued)

(58) Field of Classification Search
CPC .... H01H 85/055; H01H 85/143; H01H 85/20; H01H 85/201; H01H 2085/0412; H01H 2085/0414; H01H 2085/2085
See application file for complete search history.

(56) References Cited

U.S. PATENT DOCUMENTS 5,113,168 A * 5/1992 Lindquist ..... H01H 85/0411 337/187
5,661,628 A * 8/1997 Yamagami ..... H01G 9/0003 361/275.4
(Continued)

FOREIGN PATENT DOCUMENTS

DE 10062962 A1 7/2002
DE 202015100736 U1 6/2016
WO 2015039713 A1 3/2015

OTHER PUBLICATIONS

Extended European Search Report dated Nov. 30, 2020 for European Patent Application No. 20188673.6.

*Primary Examiner* — Jacob R Crum
(74) *Attorney, Agent, or Firm* — Kacvinsky Daisak Bluni PLLC

(57) ABSTRACT

A vertical surface mount device pass-through fuse including an electrically insulating fuse body, a fusible element disposed on a first side of the fuse body and extending between first and second terminals, an electrically insulating cap having a domed portion and a flanged portion extending from the domed portion, the domed portion disposed over the fusible element, and the flanged portion affixed to the fuse body, and a conductive lead frame having a bow portion and an elongate shank portion extending from the bow portion, wherein the bow portion is disposed on the cap and is connected to the first terminal, and wherein the shank portion extends away from the fuse body.

20 Claims, 9 Drawing Sheets

(51) Int. Cl.
*H01H 85/055* (2006.01)
*H01H 85/143* (2006.01)

(52) U.S. Cl.
CPC ..... *H01H 2085/0412* (2013.01); *H01H 2085/0414* (2013.01); *H01H 2085/2085* (2013.01)

(56) References Cited

U.S. PATENT DOCUMENTS

| | | | | |
|---|---|---|---|---|
| 5,889,658 | A * | 3/1999 | Sullivan | G01P 1/023 361/773 |
| 6,700,081 | B1 * | 3/2004 | Houck, III | H01H 9/22 200/50.07 |
| 10,553,383 | B2 * | 2/2020 | Dauer | H01H 85/143 |
| 2005/0195547 | A1 | 9/2005 | Huang | |
| 2007/0099448 | A1 | 5/2007 | Taylor | |
| 2008/0061921 | A1 * | 3/2008 | Kim | H01H 85/34 337/297 |
| 2011/0050386 | A1 * | 3/2011 | Schlenker | H05K 1/0263 337/407 |
| 2014/0238732 | A1 * | 8/2014 | Itabashi | H01H 85/10 174/260 |
| 2016/0260546 | A1 * | 9/2016 | Mori | H01G 4/12 |

* cited by examiner

VERTICAL SURFACE MOUNT DEVICE PASS-THROUGH FUSE

CROSS-REFERENCES TO RELATED APPLICATIONS

This application claims the benefit of U.S. Provisional Patent Application No. 62/883,229, filed Aug. 6, 2019, the entirety of which is incorporated by reference herein.

FIELD OF THE DISCLOSURE

This disclosure relates generally to the field of circuit protection devices and relates more particularly to a vertically oriented surface mount device fuse having an integrated lead frame that facilitates pass-through connection on a printed circuit board.

BACKGROUND OF THE DISCLOSURE

Surface mount device (SMD) fuses are commonly employed in applications in which it is desirable to implement an overcurrent protection device directly on a printed circuit board (PCB) or other substrate. A conventional SMD fuse includes a fusible element extending along the top on an insulative fuse body between first and second conductive terminals. The terminals are bent around opposing ends of the fuse body to an underside of the fuse body where they can be electrically connected (e.g., soldered) to respective contacts on a PCB, for example.

A shortcoming associated with conventional SMD fuses is that they have a relatively large footprint on a PCB or other substrate on which they are installed. A further shortcoming associated with conventional SMD fuses is that, in order to connect a SMD fuse to an external electrical component (e.g., a battery) via a pass-through connection on a PCB or other substrate, the SMD fuse must be connected to a separate pass-through terminal via a trace or conductor.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A vertical surface mount device (SMD) pass-through fuse in accordance with an exemplary embodiment of the present disclosure may include an electrically insulating fuse body, a fusible element disposed on a first side of the fuse body and extending between first and second terminals, an electrically insulating cap having a domed portion and a flanged portion extending from the domed portion, the domed portion disposed over the fusible element, and the flanged portion affixed to the fuse body, and a conductive lead frame having a bow portion and an elongate shank portion extending from the bow portion, wherein the bow portion is disposed on the cap and is connected to the first terminal, and wherein the shank portion extends away from the fuse body.

A vertical SMD pass-through fuse in accordance with another exemplary embodiment of the present disclosure may include an electrically insulating fuse body, a fusible element disposed on a first side of the fuse body and extending over a cavity in the first side of the fuse body between first and second terminals, an electrically insulating cap having a domed portion and a flanged portion extending from the domed portion, the domed portion disposed over the fusible element and the cavity, and the flanged portion affixed to the fuse body, and a conductive lead frame having a bow portion and an elongate shank portion extending from the bow portion, wherein the bow portion is disposed in flat engagement with the shank portion of the cap, with the domed portion of the cap extending through an aperture in the bow portion, the bow portion being connected to the first terminal and the shank portion extending away from the fuse body.

DETAILED DESCRIPTION

A vertical surface mount device (SMD) pass-through fuse in accordance with the present disclosure will now be described more fully with reference to the accompanying drawings, in which preferred embodiments of the vertical SMD pass-through fuse are presented. It will be understood, however, that the vertical SMD pass-through fuse may be embodied in many different forms and should not be construed as being limited to the embodiments set forth herein. Rather, these embodiments are provided so that this disclosure will convey certain exemplary aspects of the vertical SMD pass-through fuse to those skilled in the art.

Figure 1:
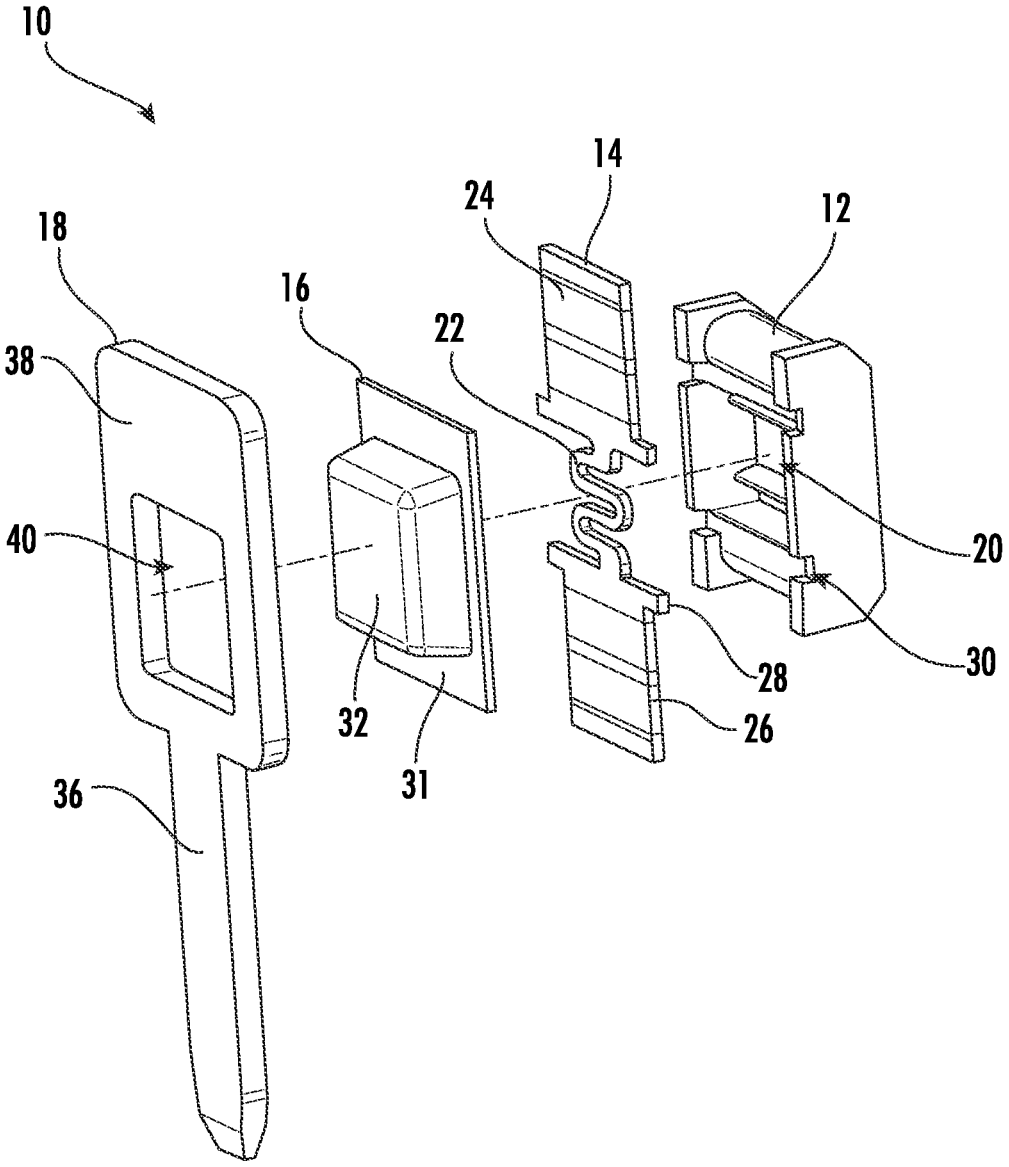
FIG. 1 is an exploded view illustrating a vertical surface mount device (SMD) pass-through fuse in accordance with an exemplary embodiment of the present disclosure in an unassembled state.
Figure 2A:
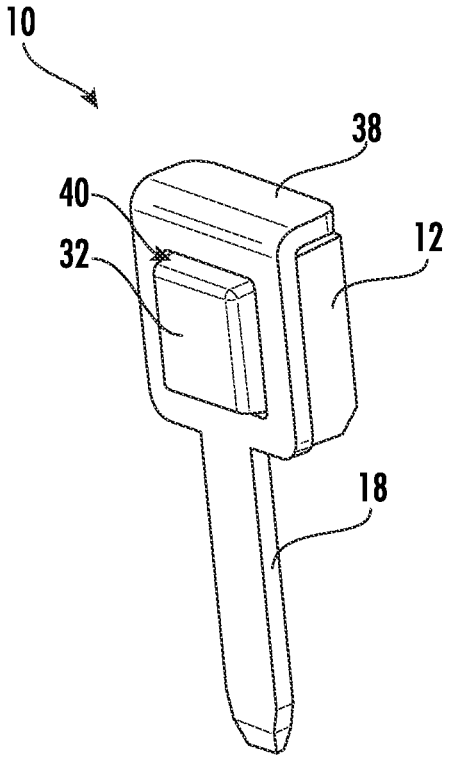
FIGS. 2A and 2B are front and rear perspective views illustrating the vertical SMD pass-through fuse shown in FIG. 1 in an assembled state.
Figure 2B:
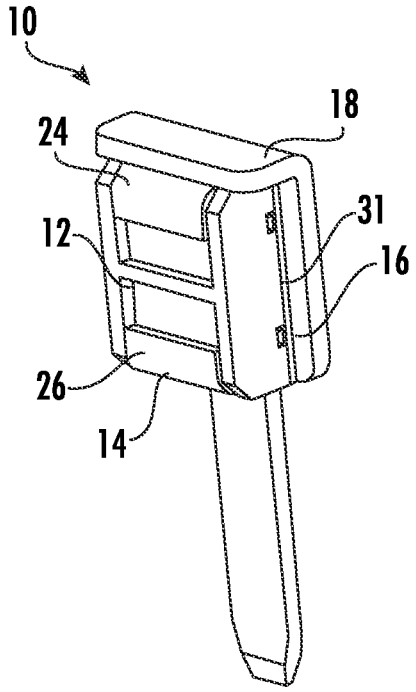

Referring to FIGS. 1-2B, exploded and perspective views illustrating a vertical SMD pass-through fuse 10 (hereinafter "the fuse 10") in accordance with an exemplary, non-limiting embodiment of the present disclosure are shown. For the sake of convenience and clarity, terms such as "front," "rear," "top," "bottom," "above," "below," "vertical," "horizontal," "lateral," and "longitudinal" may be used herein to describe the relative placement and orientation of various components of the fuse 10, each with respect to the geometry and orientation of the fuse 10 as it appears in FIGS. 1-2B. Said terminology will include the words specifically mentioned, derivatives thereof, and words of similar import.

Referring to FIG. 1, the fuse 10, which is shown in an unassembled state, may include a fuse body 12, a fuse plate 14, a cap 16, and a lead frame 18. The fuse body 12 may be a generally rectangular or block-shaped member formed of an electrically insulating material (e.g., plastic, polymer, ceramic, etc.) and may have a cavity 20 formed in a front surface thereof. The fuse body 12 may further include various surface features, protrusions, and contours for accommodating and retaining the fuse plate 14 as described in greater detail below.

The fuse plate 14 may be a substantially planar member formed from a plate or sheet of electrically conductive material (e.g., stamped from a plate of zinc, copper, tin, etc.) and may include a fusible element 22 extending between first and second terminals 24, 26. The first and second terminals 24, 26 may include flanges 28 extending in opposite directions from lateral edges thereof for fitting within complementary recesses or grooves 30 formed in the front edges of the fuse body 12. Mating engagement between the flanges 28 and the grooves 30 may facilitate accurate location and secure engagement between the fuse plate 14 and the fuse body 12 when the fuse 10 is assembled (as shown in FIGS. 2A and 2B), with the fusible element 22 extending over the cavity 20 in the front surface of the fuse body 12. Additionally, when the flanges 28 are disposed within the grooves 30, the fuse plate 14 may be recessed relative to the front edges of the fuse body 12 with the fusible element 22 disposed within the cavity 20, thereby facilitating encapsulation of the fusible element 22 as further described below.

The fusible element 22 may be configured to melt, disintegrate, or otherwise open if current flowing through the fuse plate 14 exceeds a predetermined threshold, or "current rating," of the fuse 10. In certain embodiments, the fusible element 22 may have a serpentine shape as shown in FIG. 1. The present disclosure is not limited in this regard. In various embodiments, the fusible element 22 may include perforations, slots, thinned or narrowed segments, and/or various other features for making the fusible element 22 more susceptible to melting or opening relative to other portions of the fuse plate 14. In a non-limiting example, the fusible element 22 may be configured to have a current rating in a range between 2 amps and 80 amps.

The cap 16 may be formed of an electrically insulating material (e.g., plastic, polymer, ceramic, etc.) and may include a substantially planer flanged portion 31 extending from a central domed portion 32 that defines an interior cavity (not within view). When the fuse 10 is assembled, the cap 16 may fit over the fuse plate 14 and the fuse body 12, with the flanged portion 31 of the cap 16 engaging the front edges of the fuse body 12 and the with domed portion 32 of the cap 16 covering the fusible element 22. The flanged portion 31 of the cap 16 may be affixed to the front edges of the fuse body 12 via ultrasonic welding, laser welding, epoxy, etc. Thus, the fusible element 22 may be enclosed within, and may extend through, a chamber defined by the cap 16 and the fuse body 12, and the first and second terminals 24, 26 may protrude from the top and bottom of the chamber and may extend above and below the fuse body 12 and the cap 16. In various embodiments of the fuse 10, a fuse filler material, such as sand, silica, or the like (not shown), may be disposed within the chamber defined by the cap 16 and the fuse body 12 and may substantially surround the fusible element 22 for quenching electrical arcs that could otherwise propagate upon opening of the fusible element 22 during an overcurrent condition.

The lead frame 18 may be formed from a single piece of electrically conductive material (e.g., stamped from a sheet of zinc, copper, tin, etc.) and may be generally key-shaped with an elongate shank portion 36 extending from the bottom of a bow portion 38. The bow portion 38 may have an aperture 40 formed therethrough and adapted to matingly receive the domed portion 32 of the cap 16 as further described below.

Referring FIGS. 2A and 2B, which illustrate the fuse 10 in a fully assembled state, the first and second fuse terminals 24, 26 of the fuse plate 14 may be bent or crimped around the top and bottom of the fuse body 12. The cap 16 may be disposed over the fusible element 22 (not within view) and may be fastened to the front edges of the fuse body 12 as described above. The bow portion 38 of the lead frame 18 may be disposed in flat abutment with the front of the flanged portion 31 of the cap 16, with the domed portion 32 of the cap 16 extending through the aperture 40 in the bow portion 38. The top of the bow portion 38 may be bent or crimped around the top of the fuse body 12 and may be disposed in flat engagement with the first terminal 24 of the fuse plate 14 and may be electrically connected thereto.

Figure 3A:
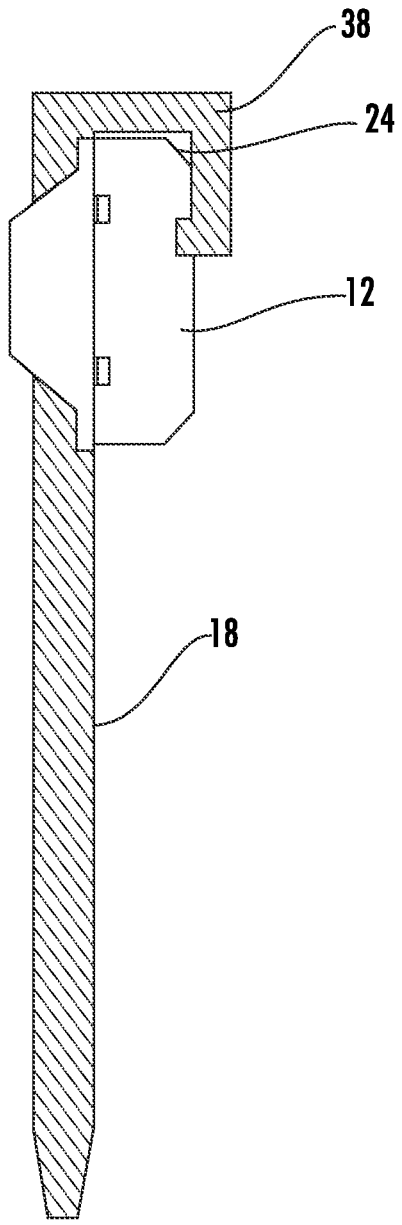
FIG. 3A is a cross sectional side view illustrating an alternative embodiment of the vertical SMD pass-through fuse shown in FIGS. 2A and 2B.
Figure 3B:
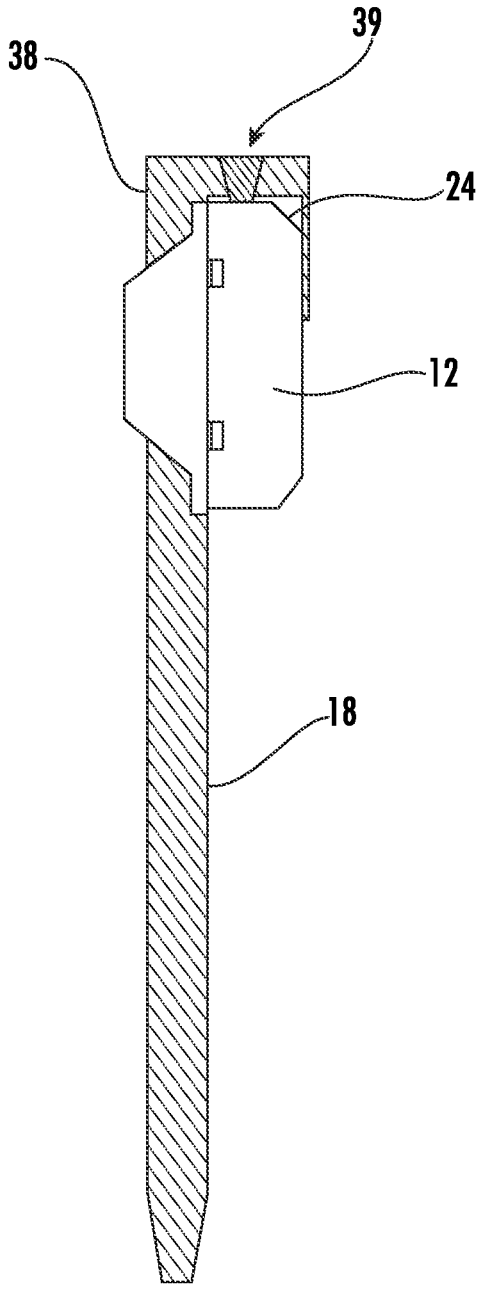
FIG. 3B is a cross sectional side view illustrating another alternative embodiment of the vertical SMD pass-through fuse shown in FIGS. 2A and 2B.

In various embodiments, the bow portion 38 may be connected to the first terminal 24 via brazing, high temperature solder, or other robust connection methods adapted to withstand high temperatures. Thus, during subsequent reflow soldering processes (such as may be performed during installation of the fuse 10, for example) the electrical connection between the bow portion 38 and the first terminal 24 will not be compromised. Alternatively, low temperature solder may be used to connect the bow portion 38 to the first terminal 24, and the bow portion 38 may be bent around the back and/or sides of the fuse body 12, as shown in FIG. 3A, for example, in a manner that traps the solder and prevents the solder from flowing out of the space between the bow portion 38 and the first terminal 24 when a subsequent reflow process is performed. In another contemplated embodiment shown in FIG. 3B, the bow portion 38 may have a hole or trough 39 formed therethrough that is located directly above the fuse body 12 and the first terminal 24. A quantity of low temperature solder may be disposed within the hole 39 and may provide an electrical connection between the lead frame 18 and the first terminal 24. Since the bottom of the hole 39 is closed by the first terminal 24, the solder may be prevented from flowing out of the hole 39 when a subsequent reflow process is performed. More generally, in various embodiments of the fuse 10, the bow portion 38 may include any type of hole, cavity, recess, groove, pocket, channel, etc. formed entirely therethrough or in a bottom side thereof for holding a quantity of solder in contact with the first terminal 24 and retaining the quantity of solder when a subsequent reflow process is performed (e.g., during installation of the fuse 10 on a printed circuit board).

Figure 4A:
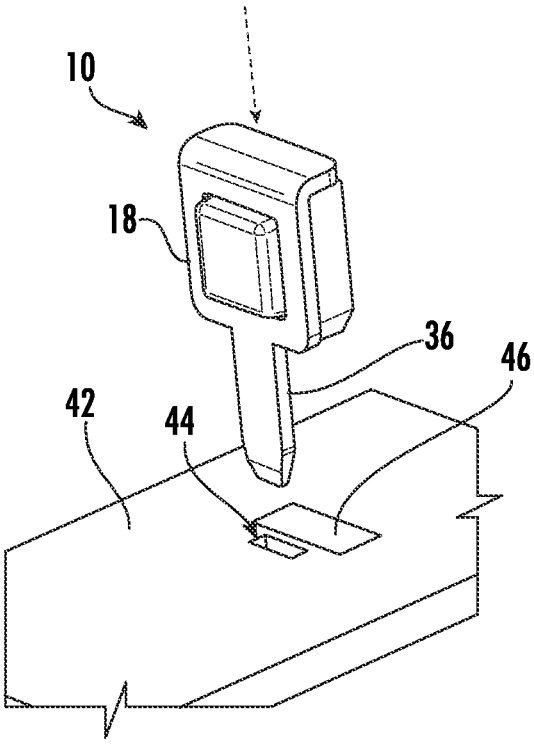
FIGS. 4A and 4B are perspective views illustrating the vertical SMD pass-through fuse shown in FIGS. 2A and 2B being installed on a printed circuit board.
Figure 4B:
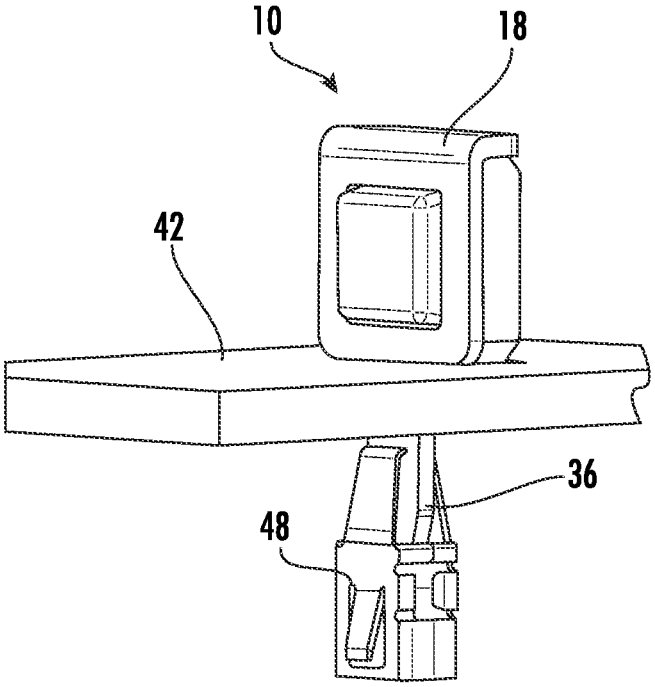

Referring to FIGS. 4A and 4B, perspective views illustrating the fuse 10 being installed on a printed circuit board (PCB) 42 are shown (it will be appreciated that the fuse 10 can be similarly installed in various insulative substrates other than PCBs). The shank portion 36 of the lead frame 18 may be inserted through a pass-through slot 44 in the PCB 42 and may be secured therein via press-fit, adhesive, solder, etc., and the second terminal 26 of the fuse plate 14 may be disposed atop a solderable pad 46 on the PCB 42. The solderable pad 46 may be subsequently reflowed to establish a robust electrical connection with the second terminal 26. One or more traces or other electrical pathways (not shown) may extend from the solderable pad 46 to other elements on the PCB 42, thereby placing such elements in electrical communication with the second terminal 26 of the fuse plate 14 (not within view). A conductor 48 may be clipped or otherwise connected to the shank portion 36 of the lead frame 18 on the lower side of the PCB 42 and may provide an electrical connection between the shank portion 36 and an external electrical element (e.g., a source of electrical power such as a battery, not shown) to which the conductor 48 is connected. With the fuse 10 installed thusly, a conductive path is established that allows current to flow from the conductor 48 to the shank portion 36 of the lead frame 18, through the bow portion 38 of the lead frame 18 to the first terminal 24, through the fusible element 22 to the second terminal 26 and to connected electrical elements or devices on the PCB 42. Thus, the fuse 10 may provide overcurrent protection between the external electrical element (connected to the shank portion 36 of the lead frame 18 by the conductor 48) and one or more electrical elements on the PCB 42.

In view of the foregoing description, it will be appreciated that the fuse 10 of the present disclosure provides numerous advantages relative to conventional SMD fuses. For example, a conventional SMD fuse, which may be substantially similar to the fuse 10 expect for the provision of the integrated lead frame 18, is typically installed on a PCB in a horizontal orientation with its first and second terminals soldered to respective contacts on the PCB. By contrast, the fuse 10 of the present disclosure is disposed on a PCB in a vertical orientation (i.e., on its edge relative to conventional SMD fuses), with only one of its terminals (i.e., the second terminal 26) soldered to the PCB. The footprint of the fuse 10 on the PCB is therefore significantly smaller than that of conventional SMD fuses. Additionally, the lead frame 18 provides the fuse 10 with an integrated pass-through terminal, thereby obviating the need for connecting the fuse 10 to a separate pass-through terminal via a trace or conductor as required for conventional SMD fuses. Still further, inserting the shank portion 36 of the lead frame 18 through a pass-through slot in a PCB (as described above) facilitates a convenient and expeditious means for automatically and accurately placing the second terminal 26 of the fuse 10 on a solderable pad on the PCB. Still further, when the lead frame 18 and the second terminal 26 of the fuse 10 are installed on a PCB in the manner described above, they reinforce the cap 16 and the fuse body 12 against horizontal movement away from one another, thereby strengthening the coupling between the cap 16 and the fuse body 12 and increasing the breaking capacity of the fuse 10 relative to conventional SMD fuses. Still further, the vertical orientation of the fuse 10 moves the fusible element 22 away from a PCB or other substrate to which the fuse 10 is mounted, thereby providing the fuse with improved thermal management relative to conventional, horizontally-mounted SMD fuses. Thermal management is further improved by the lead frame 18 which may act as a heat sink for the fuse 10.

Figure 5:
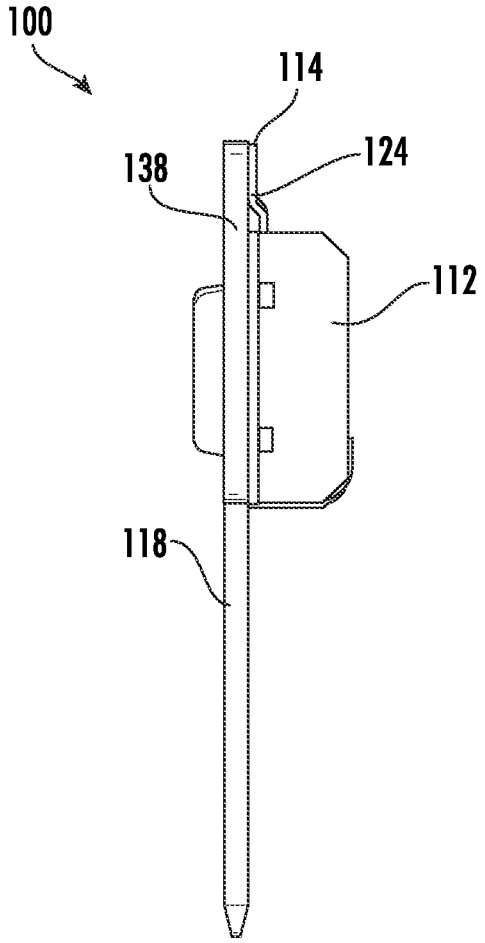
FIG. 5 is a side view illustrating another vertical SMD pass-through fuse in accordance with an exemplary embodiment of the present disclosure.

Referring to FIG. 5, a side view illustrating a vertical SMD pass-through fuse 100 (hereinafter "the fuse 100") in accordance with an alternative embodiment of the present disclosure is shown. The fuse 100 may be substantially identical to the fuse 10 described above except that the first terminal 124 of the fuse plate 114 and the bow portion 138 of the lead frame 118 are not crimped over the top of the fuse body 112. Rather, the bow portion 138 of the lead frame 118 is straight (unbent) and coplanar with the rest of the lead frame 18, and the first terminal 124 of the fuse plate 114 is bent toward, and into flat engagement with, the bow portion 138.

Figure 6:
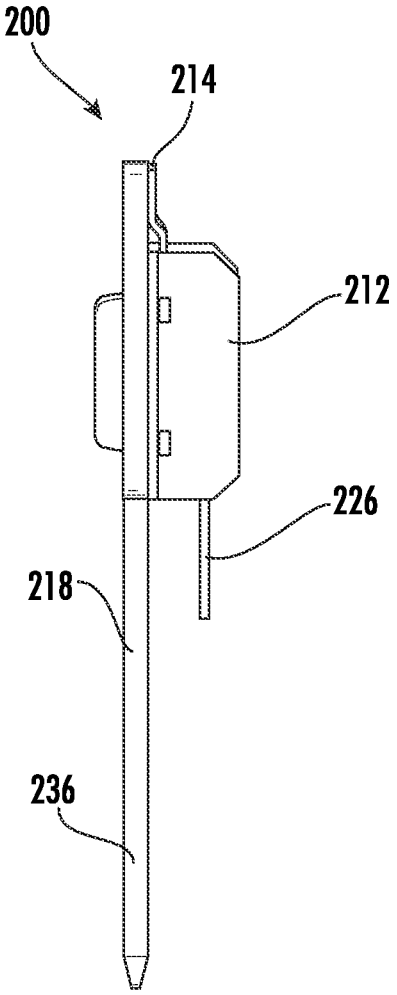
FIG. 6 is a side view illustrating another vertical SMD pass-through fuse in accordance with an exemplary embodiment of the present disclosure.

Referring to FIG. 6, a side view illustrating a vertical SMD pass-through fuse 200 (hereinafter "the fuse 200") in accordance with another alternative embodiment of the present disclosure is shown. The fuse 200 may be substantially identical to the fuse 100 described above except that second terminal 226 of the fuse plate 214 is not crimped around the bottom of the fuse body 212. Rather, the second terminal 226 of the fuse plate 214 is unbent and extends straight down from the fuse body 212, parallel to the shank portion 236 of the lead frame 218. The second terminal 226 may be inserted into, and electrically connected to (e.g., soldered to), a complementary slot or via in a PCB, for example.

Figure 7A:
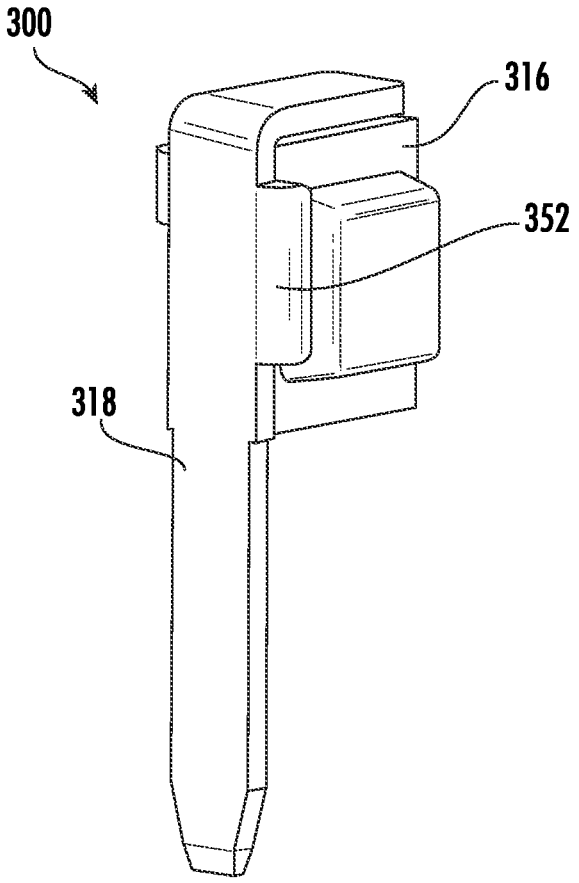
FIGS. 7A and 7B are front and rear perspective views illustrating another vertical SMD pass-through fuse in accordance with an exemplary embodiment of the present disclosure.
Figure 7B:
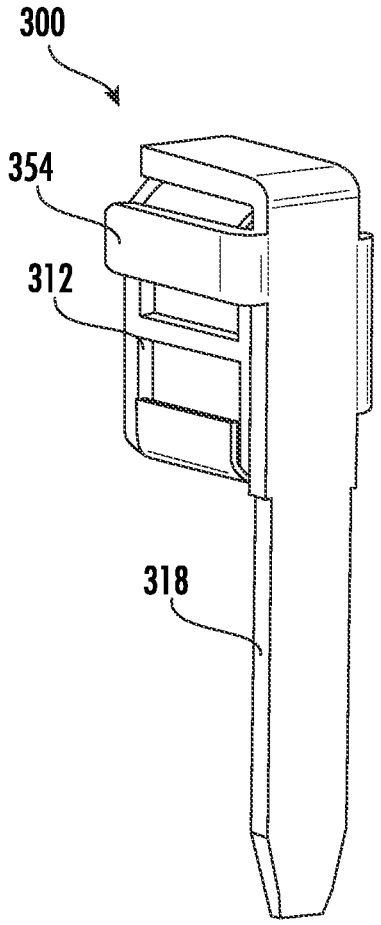

Referring to FIGS. 7A and 7B, front and rear perspective views illustrating a vertical SMD pass-through fuse 300 (hereinafter "the fuse 300") in accordance with another alternative embodiment of the present disclosure are shown. The fuse 300 may be substantially identical to the fuse 10 described above except that the lead frame 318 may be disposed on a side or edge of the fuse body 312 instead of being disposed in flat engagement with the front of the cap 316. The lead frame 318 may optionally include one or more flanges 352, 354 extending from lateral edges of the bow portion 338 that may be bent or crimped around the front of the cap 316 and the rear of the fuse body 312, respectively. The flanges 352, 354 may improve the stability of the connection between the lead frame 318 and the fuse body 312 and may also hold the fuse body 312 and the cap 316 together, thereby improving the breaking capacity of the fuse 300.

Figure 8:
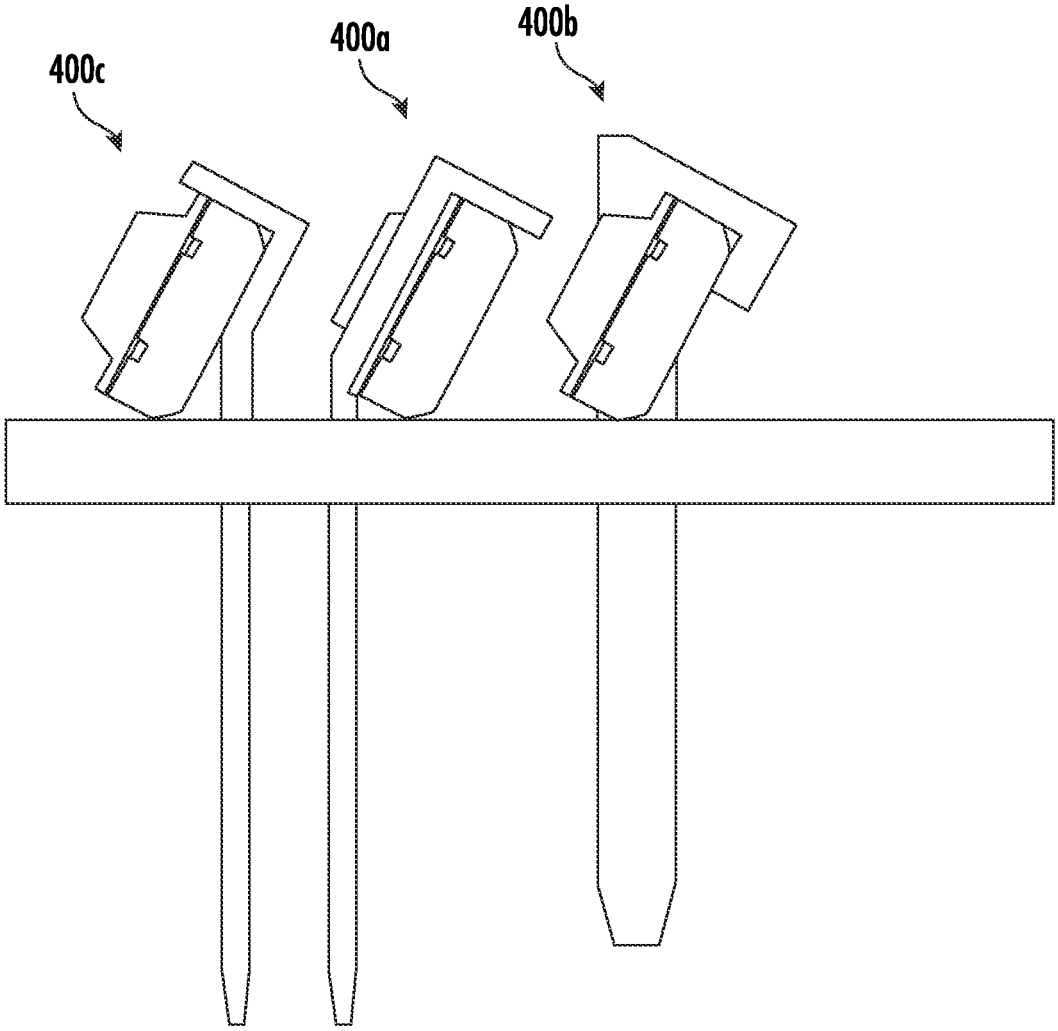
FIG. 8 is a side view illustrating several vertical SMD pass-through fuses in accordance with alternative embodiments of the present disclosure.

Referring to FIG. 8, alternative configurations 400*a*, 400*b* of the fuses 10 and 300 described above, as well as an additional fuse configuration 400*c* resembling the fuse 10 described above but with the lead frame disposed on the rear of the fuse body, are presented in which the lead frames are bent or formed such that the fuses are disposed in a tilted or non-perpendicular orientation relative to a PCB.

Figure 9A:
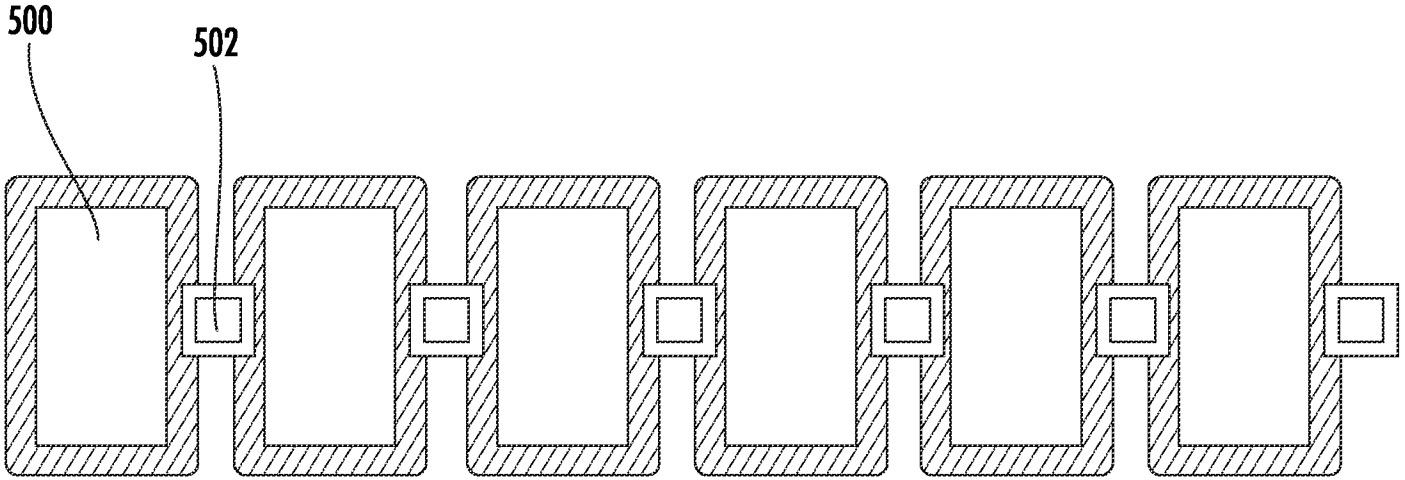
FIG. 9A is a front view illustrating a convenient packaging arrangement for caps in accordance with the present disclosure.
Figure 9B:
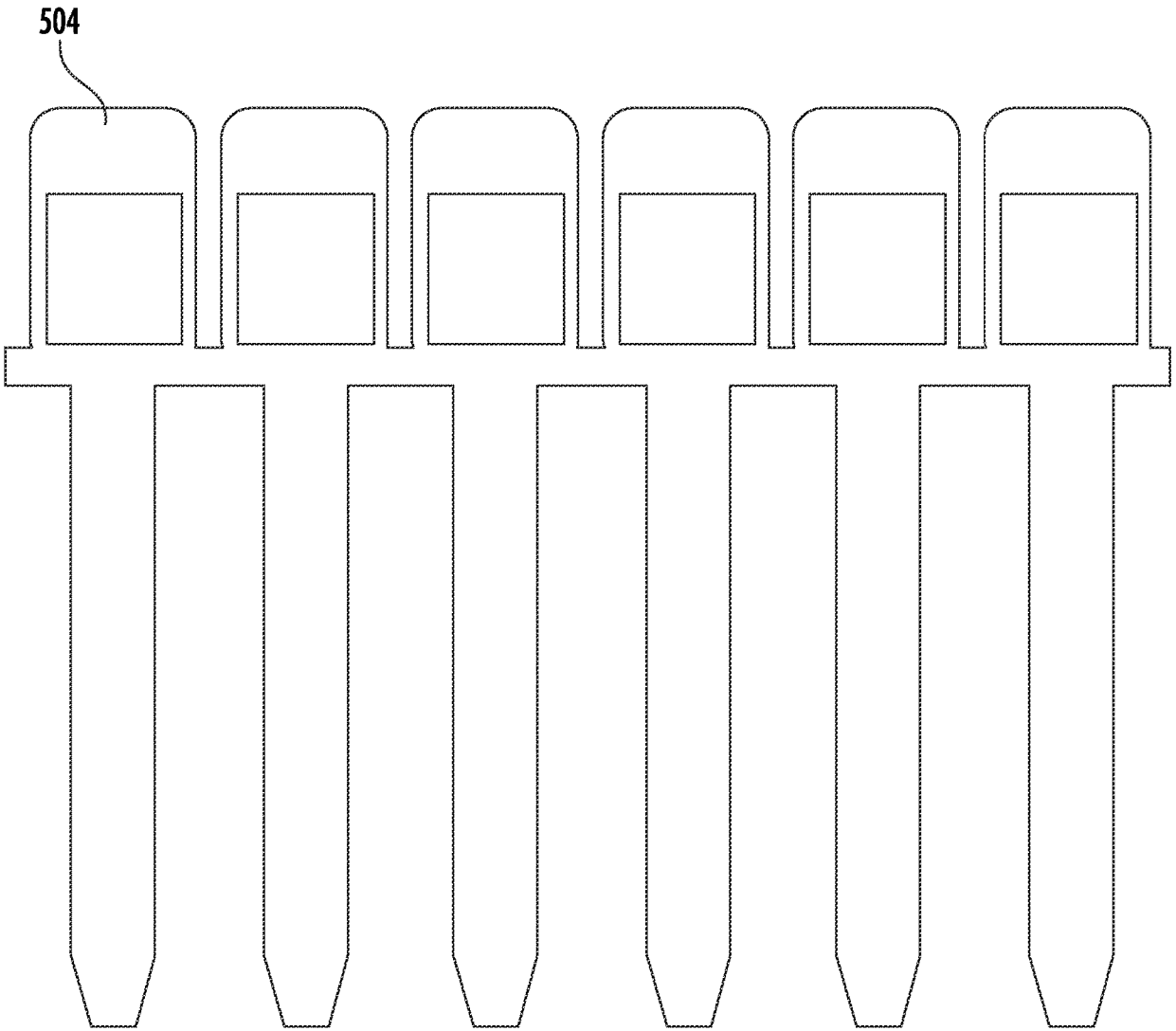
FIG. 9B is a front view illustrating a convenient packaging arrangement for fuse plates in accordance with the present disclosure.

Various components of the fuse embodiments described above may be manufactured and packaged in a manner that facilitates convenient shipping, dispensation, and installation thereof. For example, referring to FIG. 9A, a plurality of caps 500 similar to the cap 16 described above may be manufactured using a conventional over-molding process, whereby the plurality of caps 500 are connected to one another by a molded carrier strip 502 (formed by/during the same over molding process used to form the caps 500) from which the caps 500 may be subsequently removed. In another example shown in FIG. 9B, a plurality of interconnected fuse plates 504 similar to the fuse plate 14 described above may be manufactured using a conventional stamping process whereby the plurality of interconnected fuse plates 504 are simultaneously stamped from a single sheet of metal and can be subsequently separated from one another.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A vertical surface mount device (SMD) pass-through fuse comprising:

an electrically insulating fuse body;

a fusible element disposed on a first side of the fuse body and extending between first and second terminals;

an electrically insulating cap having a domed portion and a flanged portion extending from the domed portion, the domed portion disposed over the fusible element, and the flanged portion affixed to the fuse body; and a conductive lead frame having a bow portion and an elongate shank portion extending from the bow portion, wherein the bow portion is disposed on the cap and is connected to the first terminal, and wherein the shank portion extends away from the fuse body.

2. The vertical SMD pass-through fuse of claim 1, wherein the first terminal has a bent portion that extends around a first end of the fuse body and wherein the bow portion of the lead frame has a bent portion that extends over the bent portion of the first terminal.

3. The vertical SMD pass-through fuse of claim 2, wherein the second terminal has a bent portion that extends around a second end of the fuse body.

4. The vertical SMD pass-through fuse of claim 2, wherein the bent portion of the bow portion extends to a second side of the fuse body opposite the first side of the fuse body.

5. The vertical SMD pass-through fuse of claim 2, wherein the bent portion of the bow portion has an aperture formed therethrough for receiving solder.

6. The vertical SMD pass-through fuse of claim 1, wherein the domed portion of the cap extends through an aperture in the bow portion of the lead frame.

7. The vertical SMD pass-through fuse of claim 1, wherein the first terminal is disposed in flat engagement with the bow portion of the lead frame and is parallel to the shank portion of the lead frame.

8. The vertical SMD pass-through fuse of claim 1, wherein the second terminal extends away from the fuse body and is parallel to the shank portion of the lead frame.

9. The vertical SMD pass-through fuse of claim 1, wherein the lead frame has a first flange extending from the bow portion that engages the cap and a second flange extending from the bow portion that engages a second side of the fuse body opposite the first side of the fuse body.

10. The vertical SMD pass-through fuse of claim 1, wherein the first and second terminals have flanges extending from opposing sides thereof that fit into corresponding grooves in the first side of the fuse body.

11. The vertical SMD pass-through fuse of claim 1, wherein the fusible element extends over a cavity in the first side of the fuse body.

12. A vertical surface mount device (SMD) pass-through fuse comprising:

an electrically insulating fuse body;

a fusible element disposed on a first side of the fuse body and extending over a cavity in the first side of the fuse body between first and second terminals;

an electrically insulating cap having a domed portion and a flanged portion extending from the domed portion, the domed portion disposed over the fusible element and the cavity, and the flanged portion affixed to the fuse body; and a conductive lead frame having a bow portion and an elongate shank portion extending from the bow portion, wherein the bow portion is disposed in flat engagement with the shank portion of the cap, with the domed portion of the cap extending through an aperture in the bow portion, the bow portion being connected to the first terminal and the shank portion extending away from the fuse body.

13. The vertical SMD pass-through fuse of claim 12, wherein the first terminal has a bent portion that extends around a first end of the fuse body and wherein the bow portion of the lead frame has a bent portion that extends over the bent portion of the first terminal.

14. The vertical SMD pass-through fuse of claim 13, wherein the second terminal has a bent portion that extends around a second end of the fuse body.

15. The vertical SMD pass-through fuse of claim 13, wherein the bent portion of the bow portion extends to a second side of the fuse body opposite the first side of the fuse body.

16. The vertical SMD pass-through fuse of claim 13, wherein the bent portion of the bow portion has an aperture formed therethrough for receiving solder.

17. The vertical SMD pass-through fuse of claim 12, wherein the first terminal is disposed in flat engagement with the bow portion of the lead frame and is parallel to the shank portion of the lead frame.

18. The vertical SMD pass-through fuse of claim 12, wherein the second terminal extends away from the fuse body and is parallel to the shank portion of the lead frame.

19. The vertical SMD pass-through fuse of claim 12, wherein the lead frame has a first flange extending from the bow portion that engages the cap and a second flange extending from the bow portion that engages a second side of the fuse body opposite the first side of the fuse body.

20. The vertical SMD pass-through fuse of claim 12, wherein the first and second terminals have flanges extending from opposing sides thereof that fit into corresponding grooves in the first side of the fuse body.

* * * * *